US011149385B1

(12) United States Patent
McDonald

(10) Patent No.: US 11,149,385 B1
(45) Date of Patent: Oct. 19, 2021

(54) DOWEL BASKETS AND JACKETS WITH INTERCHANGEABLE DOWELS

(71) Applicant: McTech Group, Inc., Hertford, NC (US)

(72) Inventor: Stephen F. McDonald, Hertford, NC (US)

(73) Assignee: McTech Group Inc., Hertford, NC (US)

( * ) Notice: Subject to any disclaimer, the term of this patent is extended or adjusted under 35 U.S.C. 154(b) by 0 days.

(21) Appl. No.: 17/326,271

(22) Filed: May 20, 2021

Related U.S. Application Data

(60) Provisional application No. 63/027,925, filed on May 20, 2020, provisional application No. 63/063,027, filed on Aug. 7, 2020, provisional application No. 63/183,051, filed on May 2, 2021.

(51) Int. Cl.

| | |
|---|---|
| ***E01C 7/00*** | (2006.01) |
| ***E01C 11/14*** | (2006.01) |
| ***E01C 7/14*** | (2006.01) |
| ***E01C 11/06*** | (2006.01) |
| *E01D 19/06* | (2006.01) |

(52) U.S. Cl.
CPC ..... *E01C 11/14* (2013.01); *E01C 7/14* (2013.01); *E01C 11/06* (2013.01); *E01D 19/06* (2013.01)

(58) Field of Classification Search
CPC . E01C 7/14; E01C 11/06; E01C 11/14; E01D 19/06
USPC ..... 404/46–63, 134–136
See application file for complete search history.

(56) References Cited

U.S. PATENT DOCUMENTS

| | | | | |
|---|---|---|---|---|
| 2,064,705 | A * | 12/1936 | Whitehead | E04C 5/18 52/685 |
| 2,133,553 | A | 10/1939 | Lord | |
| 2,365,550 | A | 1/1944 | Heltzel | |
| 2,508,443 | A | 5/1950 | Carter | |
| 2,768,562 | A | 10/1956 | Godwin | |
| 4,531,564 | A | 7/1985 | Hanna | |
| 4,648,739 | A | 3/1987 | Thomsen | |
| 4,733,513 | A | 3/1988 | Schrader et al. | |
| 5,791,816 | A * | 8/1998 | McCallion | E04C 5/20 404/136 |
| 6,092,960 | A * | 7/2000 | McCallion | E01C 11/14 404/62 |
| 6,145,262 | A | 11/2000 | Schrader et al. | |
| 6,210,070 | B1 | 4/2001 | Shaw et al. | |

(Continued)

*Primary Examiner* — Raymond W Addie
(74) *Attorney, Agent, or Firm* — Mehrman Law Office; Michael J. Mehrman

(57) ABSTRACT

A field-assembly dowel basket for concrete construction configured for in-the-field assembly from a small number of component parts, including dowels, dowel jackets, frame wires that are assembled into dowel basket sections. The dowel jackets may support different types of dowels, such as rectangular plate dowels, diamond-shaped plate dowels and rod dowels. The dowel jackets are firmly attached to the frame wires by leg-clip structures with three clips features including two leg clips, which attach to risers of the frame wire, as well as a central clip feature that clips to the crossbar of the frame wire, to securely support the frame wire and dowel to the dowel jacket. Multiple dowel basket sections are joined together by inline connectors connecting adjacent frame wires to fabricate an elongated dowel basket of desired length.

20 Claims, 17 Drawing Sheets

(56) References Cited

U.S. PATENT DOCUMENTS

| | | | | |
|---|---|---|---|---|
| 6,354,760 | B1 | 3/2002 | Boxall et al. | |
| 6,447,203 | B1 * | 9/2002 | Ruiz | E01C 11/14 404/134 |
| 6,471,441 | B1 * | 10/2002 | Muller | E01C 11/14 404/47 |
| 7,341,334 | B2 | 3/2008 | Auslander et al. | |
| 7,404,686 | B2 | 7/2008 | Volum | |
| 7,604,432 | B2 | 10/2009 | Shaw et al. | |
| 7,738,928 | B2 | 7/2010 | Estes et al. | |
| 7,874,762 | B2 | 1/2011 | Shaw et al. | |
| 8,302,359 | B2 | 11/2012 | Boxall et al. | |
| 8,356,955 | B2 | 1/2013 | Nadler | |
| 8,454,265 | B2 | 6/2013 | Carroll | |
| 8,511,935 | B1 | 8/2013 | Thomas | |
| 9,574,309 | B2 | 2/2017 | McDonald | |
| 10,280,568 | B2 | 5/2019 | McDonald | |
| 10,443,194 | B2 | 10/2019 | McDonald | |
| 2010/0054858 | A1 | 3/2010 | Mayo et al. | |
| 2014/0270949 | A1 * | 9/2014 | Heady | E01C 11/08 404/70 |
| 2015/0204026 | A1 | 6/2015 | McDonald | |

* cited by examiner

DOWEL BASKETS AND JACKETS WITH INTERCHANGEABLE DOWELS

REFERENCE TO RELATED PATENT APPLICATIONS

This application claims priority to U.S. Provisional Pat. App. Ser. No. 63/027,925 filed May 20, 2020; U.S. Provisional Pat. App. Ser. No. 63/063,027 filed Aug. 7, 2020; and U.S. Provisional Pat. App. Ser. No. 63/183,051 filed May 2, 2021; which are all incorporated by reference.

TECHNICAL FIELD

The present invention relates to dowel devices suitable for concrete pavement construction and, more particularly, to a field-assembly dowel basket assembled from standardized components on an as-needed, where-needed basis.

BACKGROUND

Dowels are embedded into joints between adjacent slabs of concrete to prevent vertical displacement between the slabs to maintain a smooth pavement surface and increase the strength of the concrete in the region of the joint. While the dowels are embedded in the joints to prevent excessive vertical displacement between the slabs, they may be designed to allow a small amount of horizontal separation as well as vertical and lateral displacement between the slabs to relieve internal stress to accommodate drying shrinkage and thermal expansion and contraction of the slabs. This permits a normal amount of slab movement to prevent excessive cracking while still maintaining a sufficiently smooth top surface of the pavement.

In pavement construction, a series of dowels are typically installed at each expansion joint between adjacent sections or slabs of pavement. A long structure known as a dowel basket is typically used to hold a line of dowels in place at the edge of a section of pavement before the slab is poured. The basket positions each dowel so that half of the dowels will be embedded in the concrete slab to be poured, with the other half to be embedded in the adjacent slab to be poured next. An expansion joint is typically formed into the joint or cut into the dried concrete above the dowel basket at each expansion joint. The pavement is thus constructed section after section, and in some cases mile after mile, with a line of dowels held in place by a dowel basket embedded into the concrete at each expansion joint. A range of pavement structures are constructed in this manner, such as roads, bridge decks, airport runways, sidewalks, floors, buildings, and so forth. The term "pavement" for this purpose includes walls, roofs, ceilings, caisson, and other structures as well as roads, bridges, floors and sidewalks. Pavement is typically manufactured from concrete, but may be made from any suitable material poured in sections.

Constructing a concrete road in this manner requires the dowel baskets to be continually manufactured and made available at the construction site as section after section, and mile after mile, of road is poured. In conventional concrete road construction, the dowel baskets are welded together at a welding shop and then transported, typically by truck, to the construction site. For a long road construction project, a series of welding jobbers may be contracted along the route as the road is constructed. Dowel basket fabrication can be a significant logistical challenge and a major cost factor in concrete road construction. A similar concern can arise in any project utilizing large numbers of joined concrete sections, such as high-rise buildings, sidewalks, bridges, dams, and so forth. At times, dowel basket fabrication may become the critical path item, causing construction crews to sit idle waiting on dowel basket delivery before construction of the project can continue. As a result, there is a persistent need for cost effective solution to dowel basket manufacturing to facilitate concrete pavement construction.

SUMMARY OF THE INVENTION

The present invention meets the needs described above in a field-assembly dowel jacket and basket for concrete construction configured for in-the-field assembly from standardized components, including dowels, dowel jackets, wire frames, and inline plastic connectors. This allows a number of standard components to be conveniently transported and stored on construction sites to facilitate on-site assembly of the dowel baskets on an as-needed, where-needed basis. Since the dowel basket components are much smaller than assembled baskets, they can be shipped in bulk and stored much more cost effectively. Standardization of components allows mass production, bulk shipping, consolidated inventory management, and avoids the need for ad hoc fabrication for each construction site. On-site dowel basket assembly eliminates welding from the dowel basket fabrication process, avoids shipping of fabricated dowel baskets, and allows assembly of dowel basket by construction workers as opposed to highly skilled welding shops.

The dowel jacket has a crab-shaped elongated body with a leg-clip structures on each end. The dowel clips into the elongated body, while a frame wire clips into each leg-clip structure. The same dowel jacket may be configured to interchangeably support rectangular plate dowels, elongated diamond-shaped plate dowels, and/or round bar dowels. The frame wires have a "W" shape similar to those described in U.S. Pat. No. 10,443,194, which is incorporated by reference. The leg-clip structures of the dowel jacket support the frame wires sufficiently to eliminate the need for "T" connectors and shipping wires utilized in the dowel baskets described in U.S. Pat. No. 10,443,194, thus reducing the number of parts, simplifying the assembly, and increasing the rigidity of the dowel basket.

In a representative embodiment, two frame wires support two dowel jackets, each supporting a dowel to form a dowel basket section. The dowel jacket includes two leg-clip structures, each firmly attaching the dowel jacket to a respective frame wire. Each leg-clip structure includes three clips features including two leg clips, which attach to risers of the frame wire, as well as a central clip feature that clips to the crossbar of the frame wire, to securely attach the frame wire and dowel to the dowel jacket. Multiple dowel basket sections are joined together by inline connectors connecting adjacent frame wires to fabricate an elongated dowel basket. The dowel basket is positioned to span an expansion joint between adjacent concrete slabs as the slabs are poured to fabricate concrete structures, such as roads, bridge decks, floors, and the like.

DETAILED DESCRIPTION OF THE EMBODIMENTS

Figure 1A:
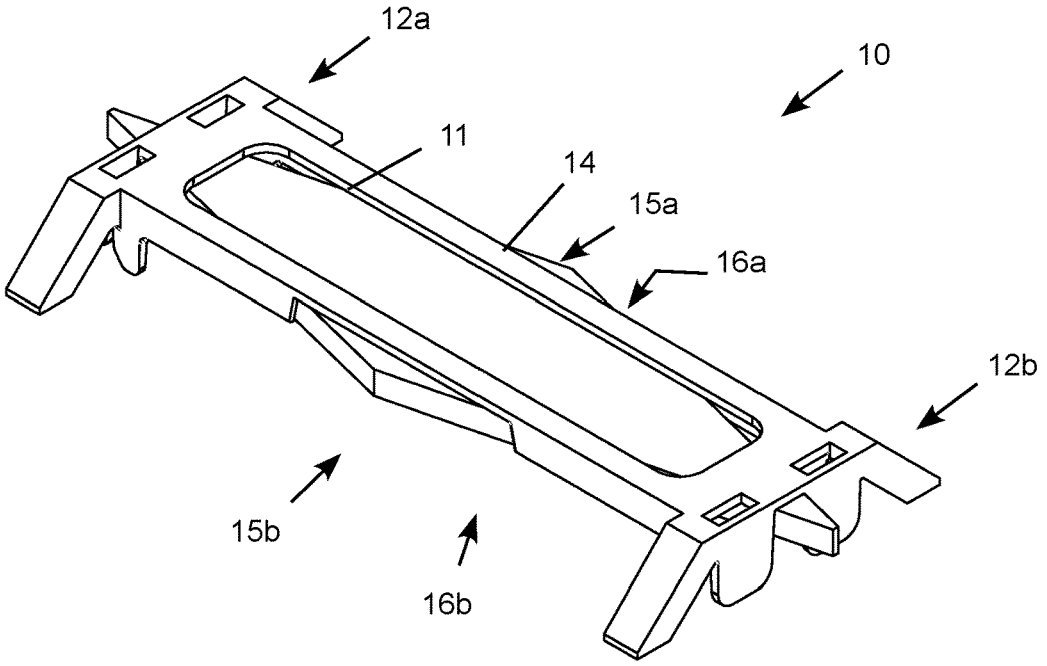
FIG. 1A is a perspective top view of a dowel jacket supporting an elongated diamond-shaped dowel for use in concrete fabrication.

Embodiments of the invention may be realized in a dowel jacket and a field-assembly dowel basket, components for a field-assembly dowel basket, a method for constructing a concrete road or other structure using the field-assembly dowel baskets, and a road or other structure constructed with the field-assembly dowel baskets. Rather than the conventional approach of fabricating dowel baskets at welding shops and transporting the fabricated dowel baskets to the construction site, embodiments of the present invention provide field-assembly dowel baskets assembled at the construction site from a small number of standard components.

The field-assembly dowel basket is assembled from a small number of component parts, including dowels jackets, dowels supported by the dowel jackets, "W" shaped frame wires that clip into the dowel jackets to support the dowels within the jackets, and inline connectors that join the frame wires of basket sections together. The dowels, dowel jackets, frame wires, and inline plastic connectors can therefore be manufactured off-site as unassembled components and transported in bulk to the construction site, where they are stored in bulk and assembled in the field on an as-needed, where needed basis. Once assembled, the dowel basket is positioned at the edge of a first concrete slab prior to pouring the slab. The dowel basket holds the dowels in place about midway up the thickness of the slab. A concrete form is positioned around the dowels near the centerline of the dowel basket. The first slab is poured so that about half of the dowels extend into the slab and half extend beyond the slab. After the first slap sets, the form is removed and a second slab is poured over the portions of the dowels that extending beyond the first slab. An expansion joint is typically formed or cut over the dowel basket at the intersection of the two slabs. See U.S. Pat. No. 10,443,194, which is incorporated by reference.

In an illustrative embodiment, each field-assembly dowel basket is formed from a number of dowel basket sections that each removably hold two dowels in place. Any number of dowel basket sections can be connected together with incline connectors to form a dowel basket of desired length, which typically extends laterally across the road or other structure under construction. Each dowel basket section includes a pair of frame wire side components connected to each other by a dowel jacket supporting a dowel. The same dowel jacket can be used to interchangeably support an elongated diamond-shaped plate dowel, and/or a rectangular plate dowel, and/or a bar dowel. The frame wire sides are spaced apart from each other by the dowel jackets. Each frame wire is formed form a single "W" section of wire. As a result, only one type of wire component is required, the "W" shaped frame wire side component. In addition, only one type of connector is required, the inline connector used to join the frame wires of adjacent basket sections together.

In an alternate embodiment, clips are used to attach a round dowel bar (i.e., a dowel bar with a round cross-section) to a dowel jacket. The dowel bar may be may be attached to the top side or the bottom side of the dowel jacket. These dowel jackets may be configured to only support round dowel bars, or they may be further to interchangeably support elongated diamond-shaped and/or rectangular plate dowels. For each of these embodiments with a dowel bar or a plate dowel attached to the bottom side of the dowel jacket, tape may attached below the dowel enclosing the bottom side of the dowel jacket to prevent the concrete from hardening the dowel to the dowel jacket. This accommodates relative movement of the concrete slabs without cracking the concrete.

The dowel jacket may be fabricated from an injection molded plastic, such as polypropylene, polyethylene, polyethylene terephthalate (PET), polyvinyl chloride (PVC) or any other suitable material. As an option, the dowel jackets may be fabricated from high-strength plastic, such as acrylonitrile butadiene styrene (ABS) or polycarbonate. The frame wires may be manufactured from the type of spring steel wire typically used in wire mesh for concrete reinforcement. The inline connectors may be made from a suitable inexpensive plastic such as polypropylene, polyethylene, PET or PVC.

While specific dimensions may vary as a matter of design choice, the following dimensions are typical for an illustrative embodiment. The drawings are generally shown to scale. The rectangular plate dowels are typically 12 inches (305 mm) long, 2 to 2.5 inches (51 to 64 mm) wide, and ¼ to ½ inch (6.4 to 12.7 mm) thick. The round bar dowels are typically 15 to 18 inches long (381 to 457 mm) and ⅜ to ¾ inch (9.5 to 19 mm) in diameter. The dowel-to-dowel spacing is typically 18 to 24 inches (457 to 610 mm). The side-to-side spacing between the "W" wire frames is typically 12 inches (305 mm). The basket supports the dowels midway in the slab to be poured (e.g., 4 inches (102 mm) for 8-inch (203 mm) thick slab) above the base where the concrete is to be poured. The wire frame components may be made from ¼ to ⅜ inch (6.4 to 9.5 mm) diameter concrete reinforcement steel wire. In an illustrative embodiment, the plate dowels may be stamped from mild steel ¼ to ½ (6.4 to 12.7 mm) inch thick. The frame wires may be 5/16-inch (8 mm) diameter spring steel wires bent into the desired shape.

Figure 1B:
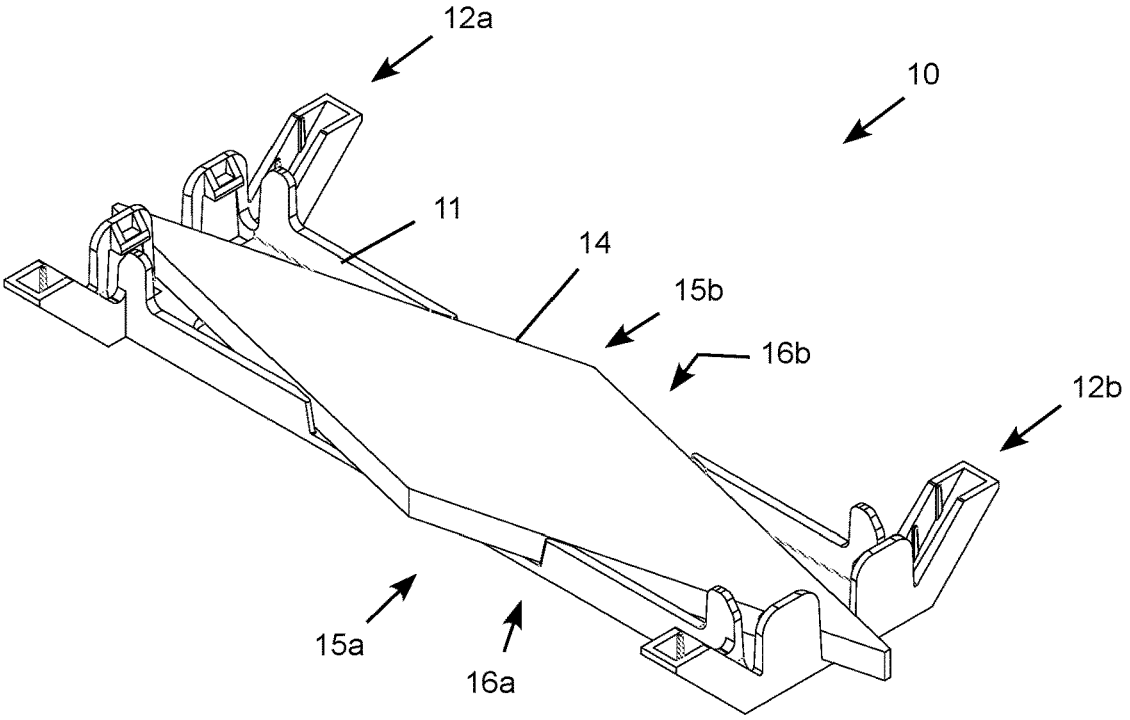
FIG. 1B is a perspective top view of the dowel jacket supporting an elongated diamond-shaped dowel.
Figure 2A:
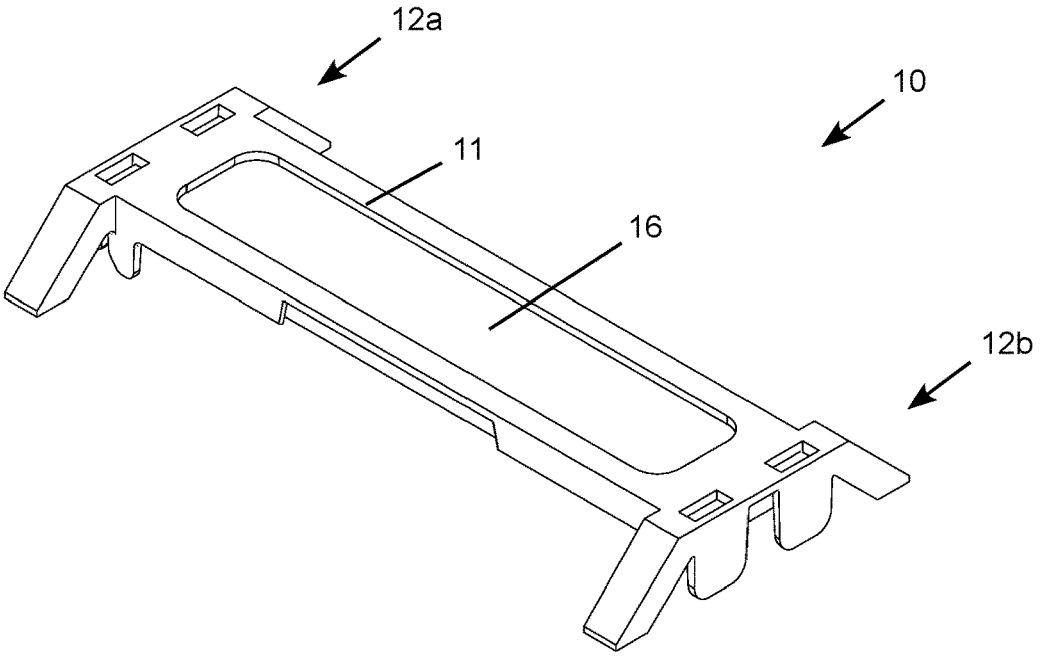
FIG. 2A is a perspective top view of the dowel jacket supporting a rectangular dowel.
Figure 2B:
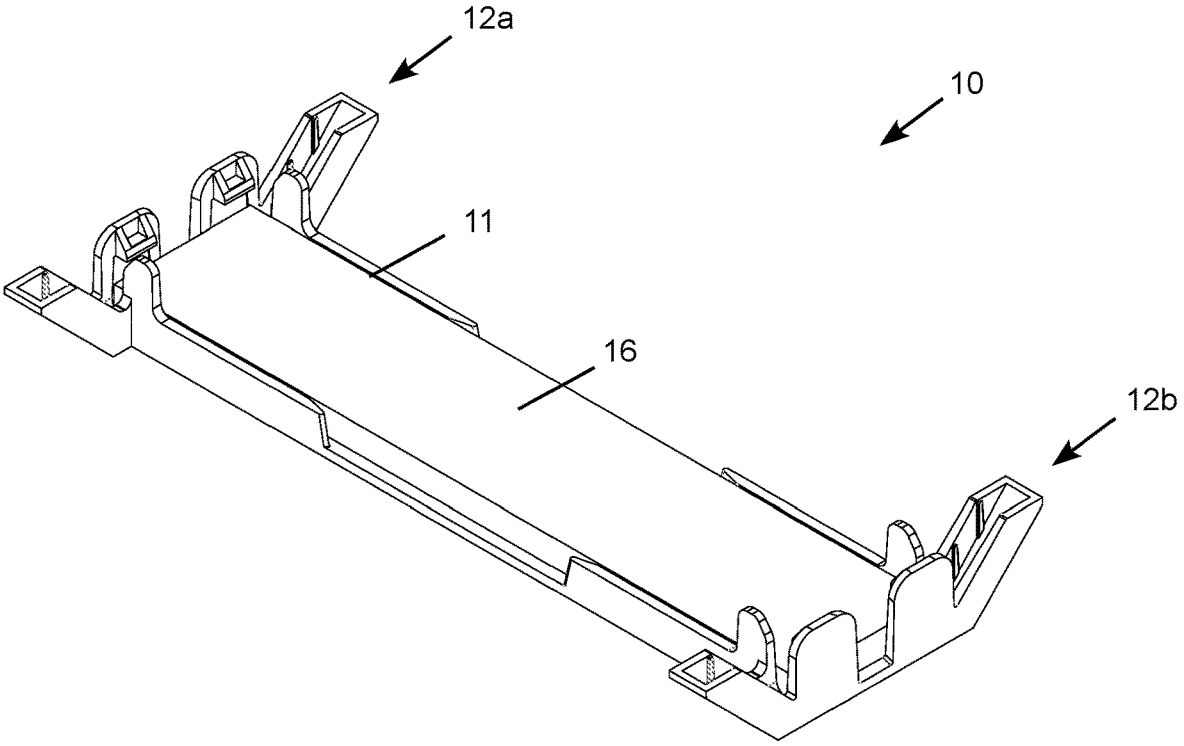
FIG. 2B is a perspective bottom view of the dowel jacket supporting the rectangular dowel.

FIG. 1A is a perspective top view, and FIG. 1B is a perspective bottom view of a dowel jacket 10 supporting an elongated diamond-shaped plate dowel 14. FIG. 2A is a perspective top view, and FIG. 2B is a perspective bottom view of the same dowel jacket 10 supporting an elongated rectangular plate dowel 16. In this embodiment, the same dowel jacket 10 is configured to interchangeably receive the elongated diamond-shaped plate dowel 14 or the elongated rectangular plate dowel 16, which both removably fit into the dowel jacket where they are secured in place by frame wire clipped to the dowel jacket 10. The dowel jacket 10 includes an elongated body 11 and leg-clip structure 12*a* and 12*b*, one on each end of the elongated body. The leg-clip structure 12*a* and 12*b* that firmly support the frame wires, which clip into the leg-clip structures. As shown in FIGS. 1A and 1B, the diamond-shaped plate dowel 14 has pointed sides portions 15*a* and 15*b* that extend through of openings 16*a* and 16*b*, respectively, of the elongated body 11 of the dowel jacket 10 The openings allow the same dowel jacket to house the diamond-shaped plate dowel 14 as shown in FIGS. 1A and 1B, as well as the rectangular plate dowel 16 as shown in FIGS. 2A and 2B.

Figure 3:
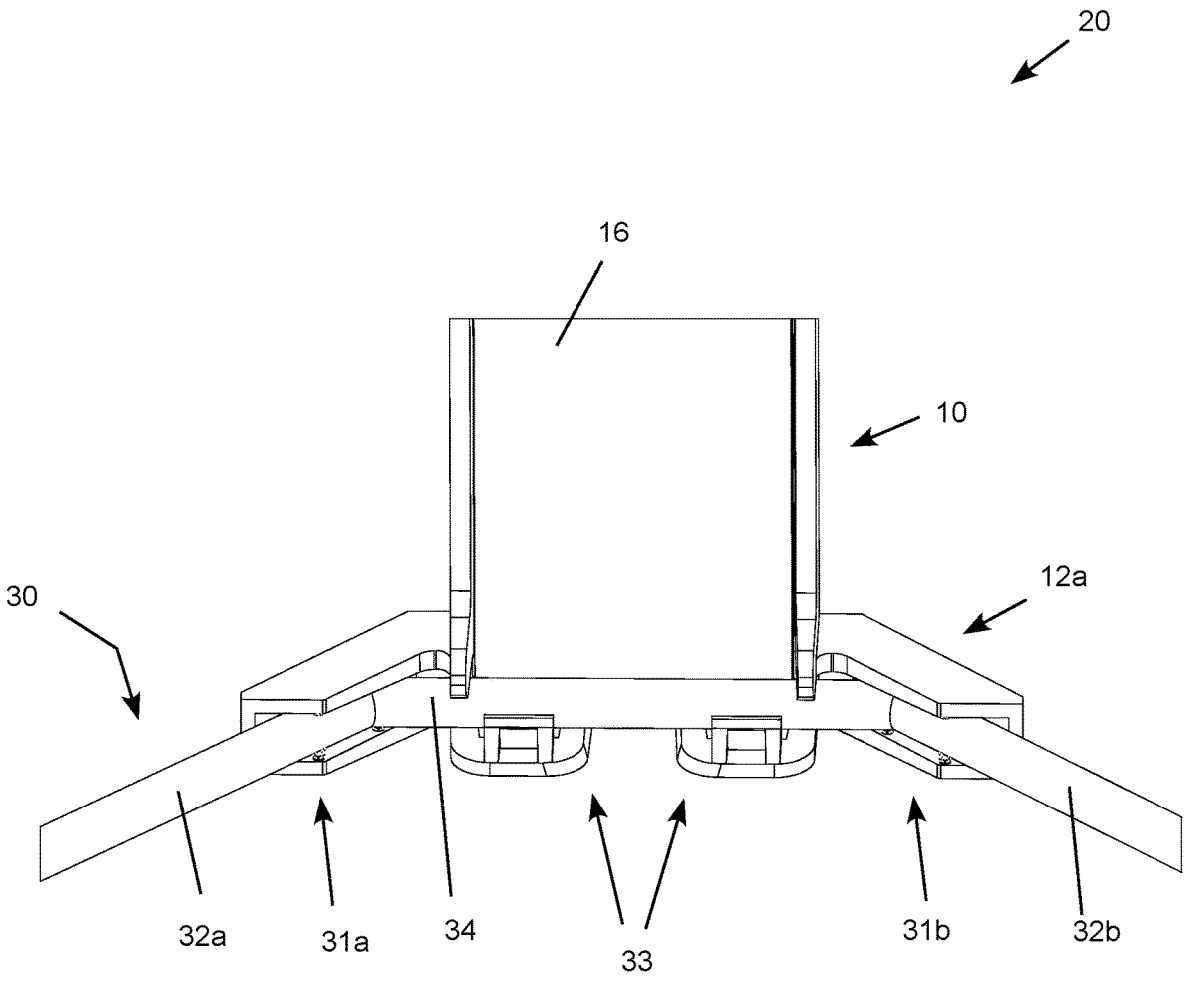
FIG. 3 is a close-up view of the clip connection between the dowel jacket, the dowel, and the frame wire.

FIG. 3 is a shows a close-up view of the clip connection between the dowel jacket 10, in this example the rectangular plate dowel 16, and a frame wire 30. In this example, the frame wire 30 clips into the leg-clip structure 12*a*, which clips the plate dowel 16 into the dowel jacket 10. The leg-clip structure 12*a* of the dowel jacket 10 includes three clips features including two leg clips 31*a* and 31*b*, which clip to risers 32*a* and 32*b* of the frame wire, respectively, as well as a central clip feature 33 that clips to the crossbar 34 of the frame wire 30, to securely attach the frame wire and dowel 16 to the dowel jacket 10. The frame wire 30, which is clipped to the leg-clip structure 12*a* of the dowel jacket 10, supports the dowel 16 within the dowel jacket 10.

Figure 4:
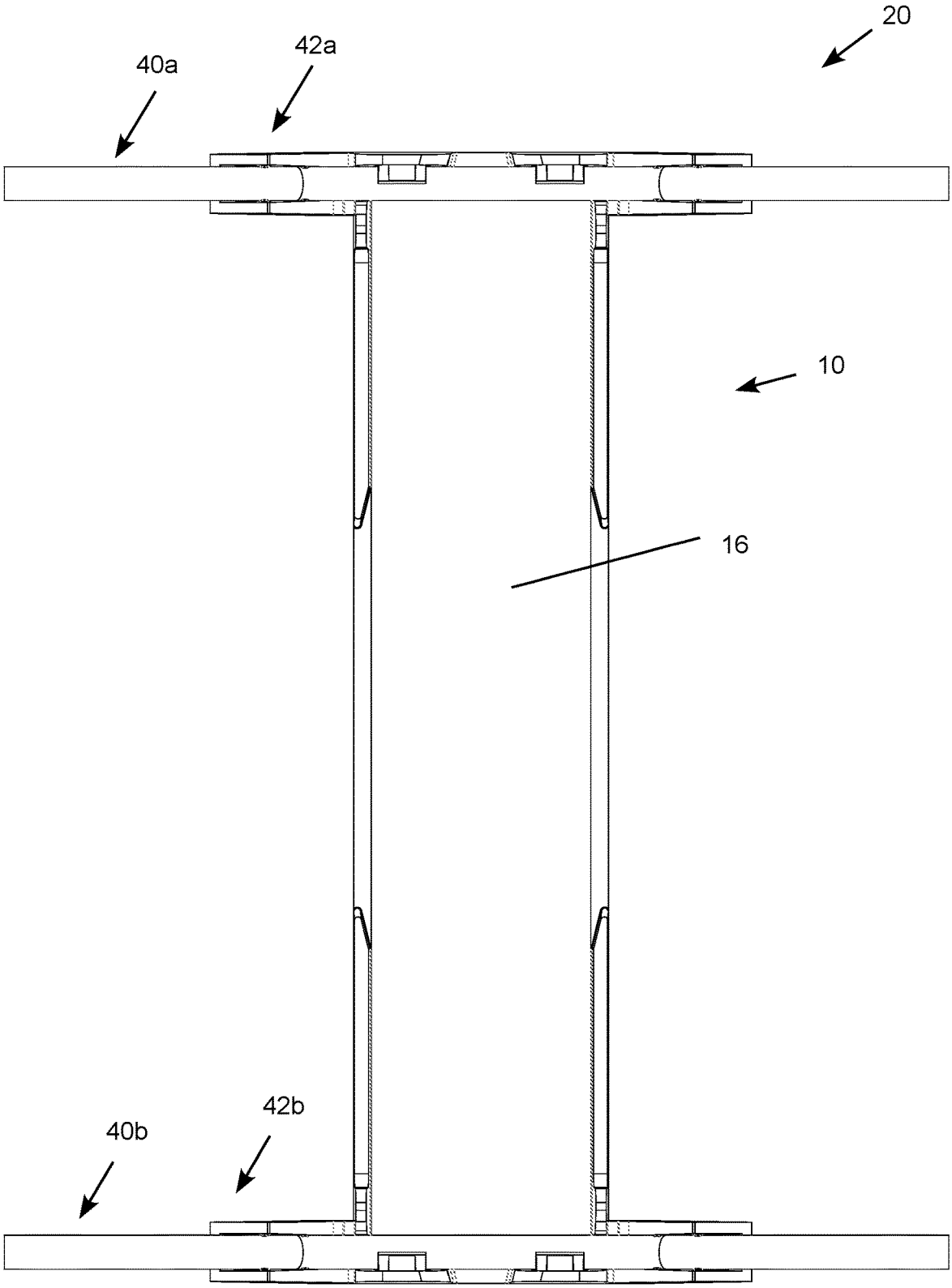
FIG. 4 is a bottom view of the dowel jacket supporting the rectangular dowel with a pair of frame wires attached.
Figure 5:
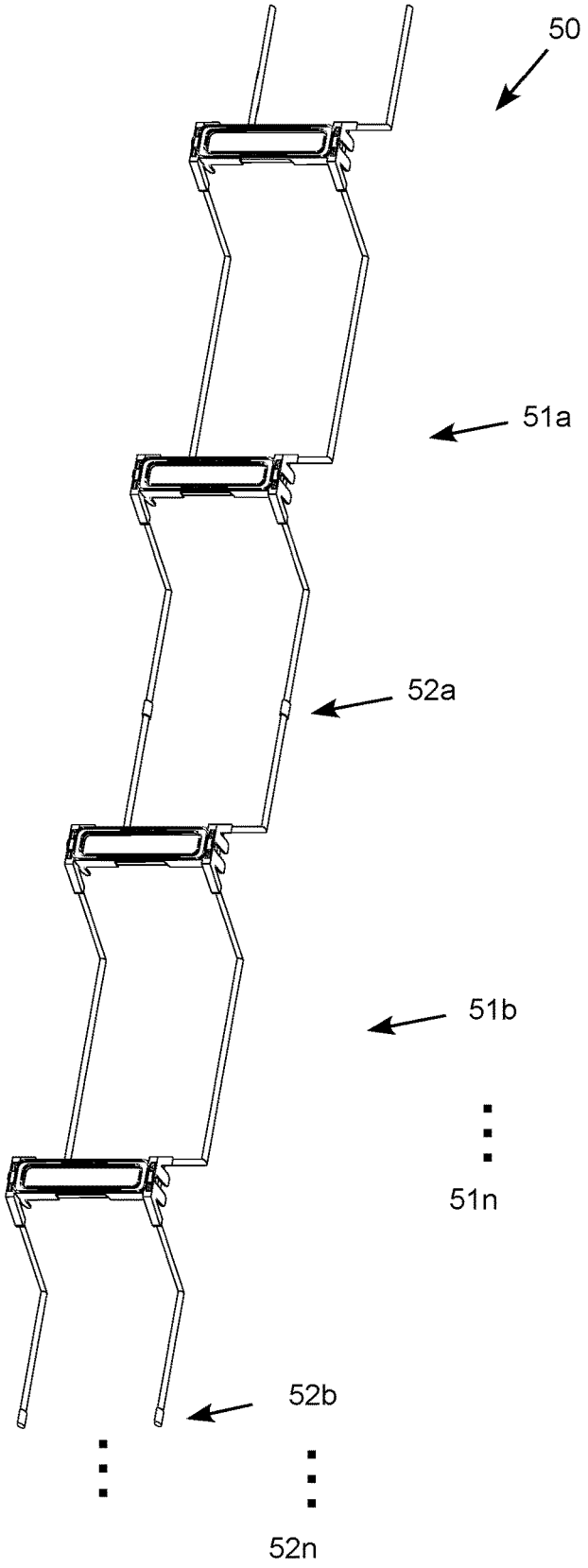
FIG. 5 is perspective view of a dowel basket assembled from multiple dowel basket sections joined by inline connectors.
Figure 6:
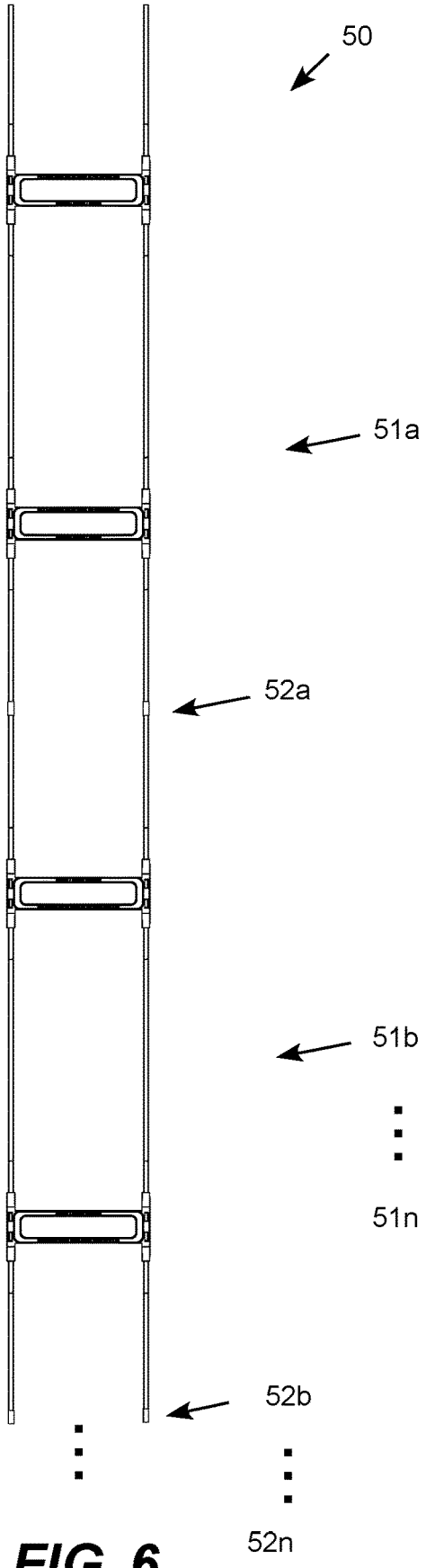
FIG. 6 is a top view of the dowel basket of FIG. 5.

FIG. 4 is a shows a bottom view of a dowel basket section 20 including a dowel jacket 10 supporting a dowel, in this example the rectangular plate dowel 16, with a pair of frame wires 40*a*-40*b* clipped into the leg-clip structures 42*a*-42*b*, respectively, of the dowel jacket as described above, so that the frame wires 40*a*-40*b* support the dowel 16 within the dowel jacket 10. The leg-clip structures provide sufficient support to the frame wires 40*a*-40*b* to avoid the need for shipping wires extending between the frame wires at the junctions between adjacent dowel basket sections. FIGS. 5 and 6 is show a dowel basket 50 assembled from several dowel basket sections 51*a*-51*n* joined by plastic inline connectors 52*a*-52*n*.

Figure 7:
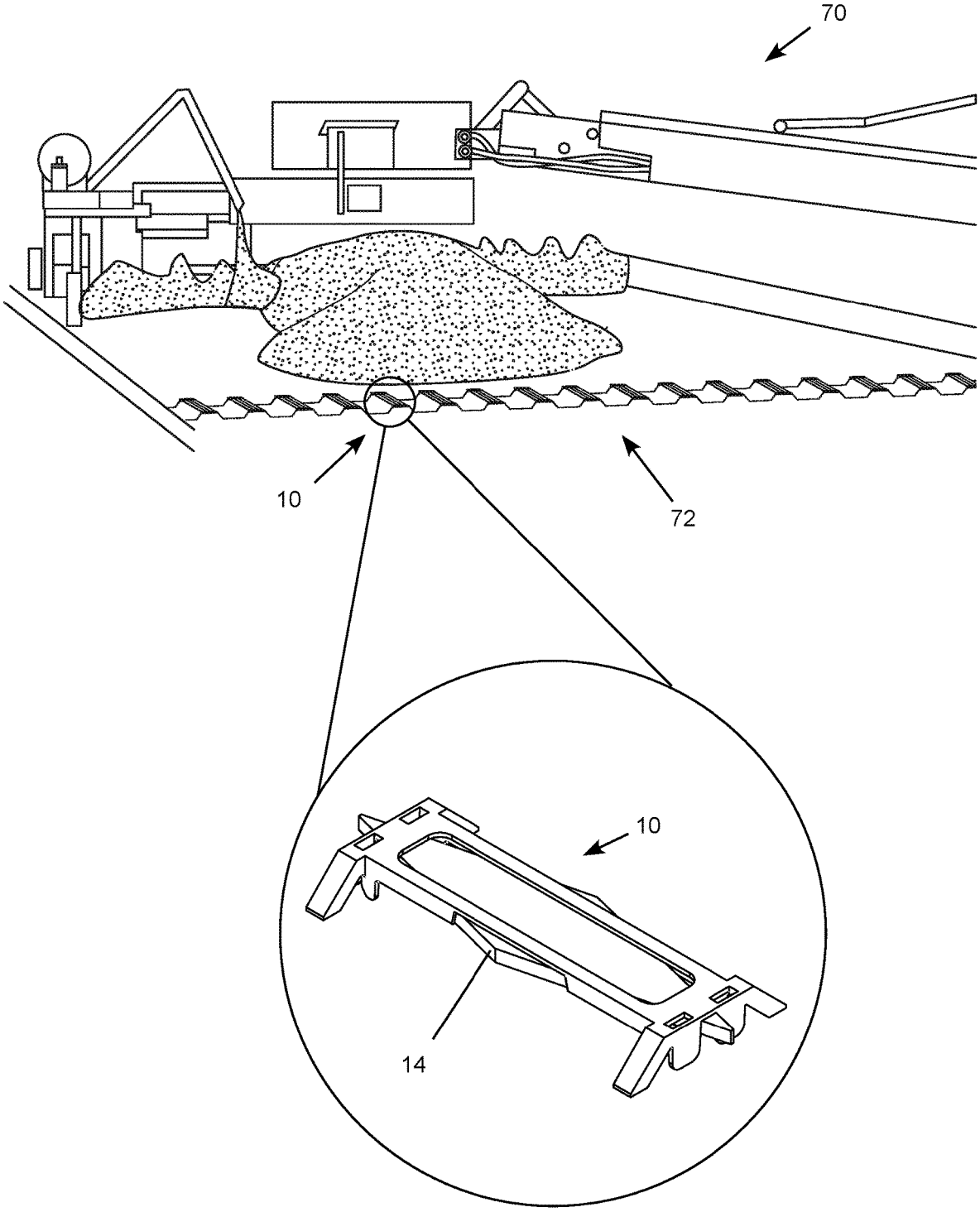
FIG. 7 is a conceptual illustration of a section of road being constructed using field-assembly dowel baskets.

FIG. 7 is a conceptual illustration 70 of concrete road construction using a field-assembly dowel basket 72, which includes a number of dowel jackets represented by the enumerated dowel jacket 10. In this example, the enumerated dowel jacket 10 houses an elongated diamond-shaped plate dowel 14. The concrete forms are not shown to avoid cluttering the figure (See U.S. Pat. No. 10,443,194).

Figure 8:
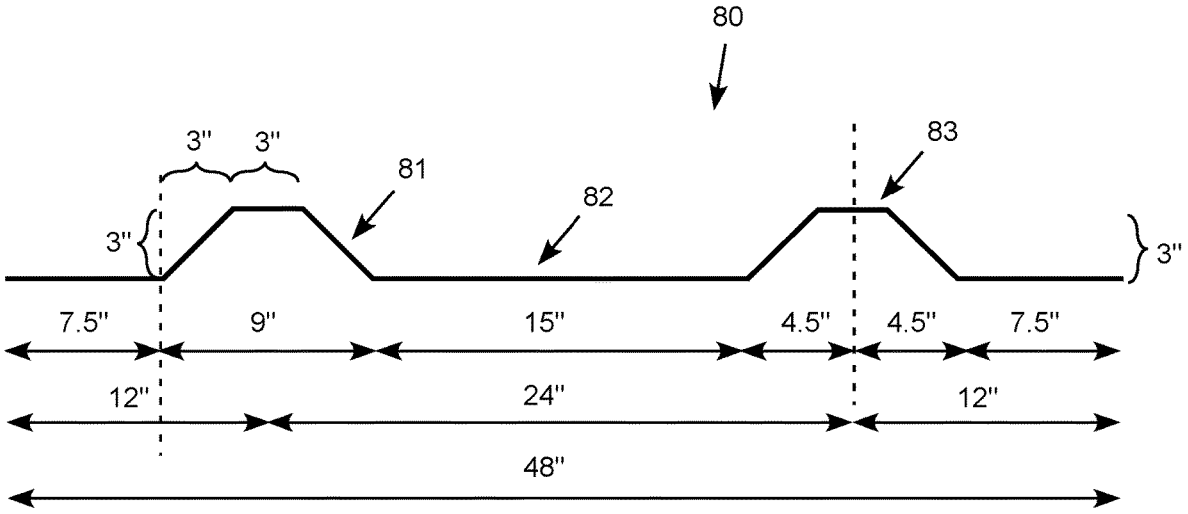
FIG. 8 shows a representative layout with dimensions of the frame wire.

FIG. 8 shows a layout of a representative frame wire 80 with dimensions. Each frame wire 80 includes risers represented by the enumerated riser 81 connecting ground runners represented by the enumerated ground runner 82 to crossbars represented by the enumerated crossbar 83. In the example, each section of frame wire 80 includes two crossbars and four risers, corresponding to a dowel basket section that includes two frame wires and two dowel jackets.

Figure 9A:
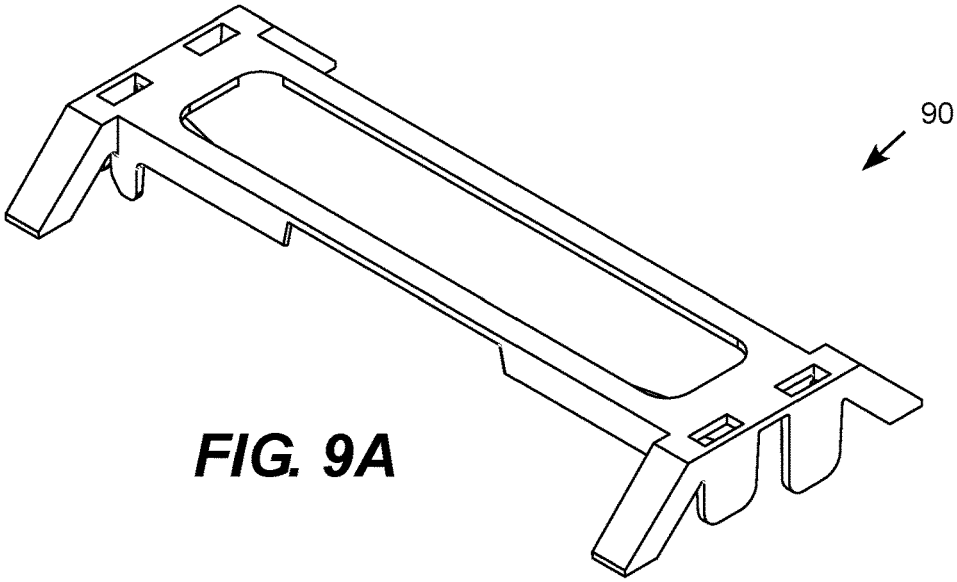
FIG. 9A is a perspective view of a dowel jacket.
Figure 9B:
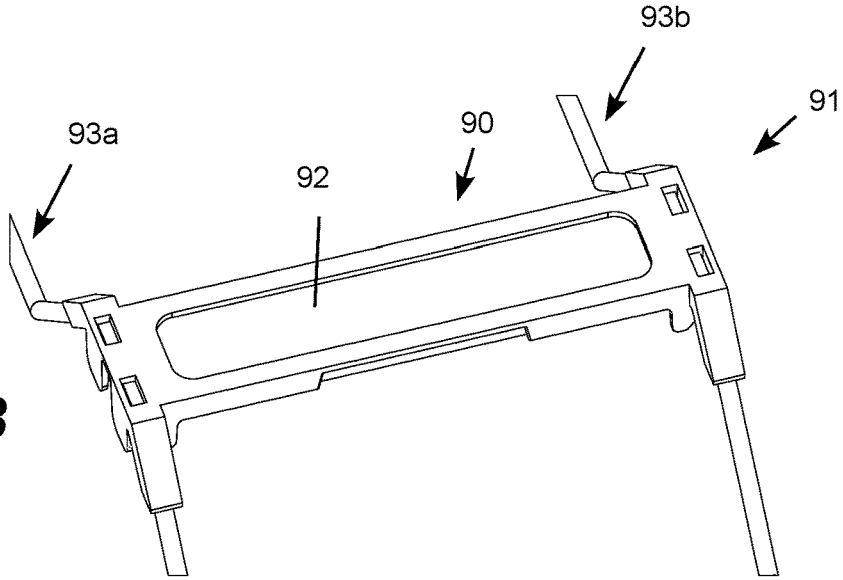
FIG. 9B is a perspective view of a dowel basket section.
Figure 9C:
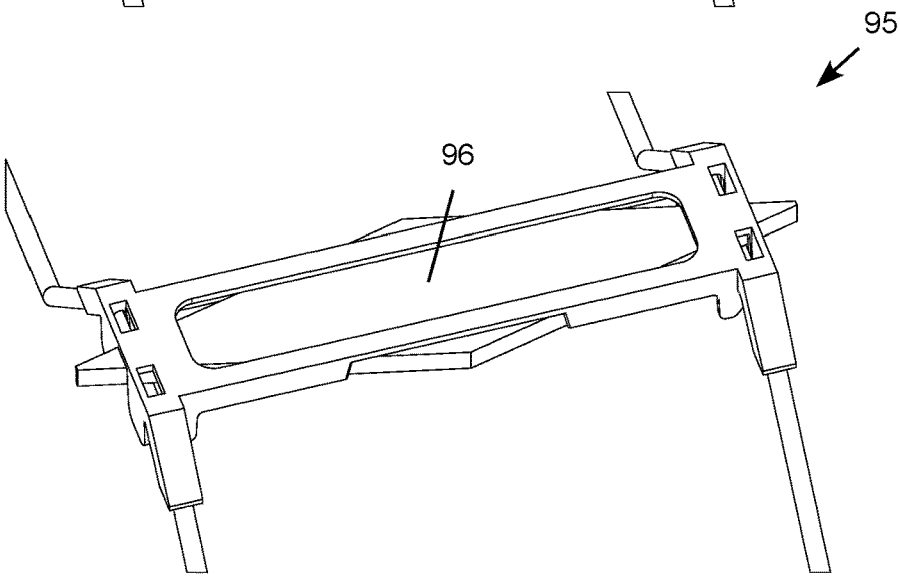
FIG. 9C is a perspective view of an alternate dowel basket section.

FIG. 9A shows a dowel jacket 90, FIG. 9B shows a dowel jacket section 91 supporting a rectangular plate dowel 92, and FIG. 9B shows a dowel jacket section 95 supporting an elongated diamond-shaped plate dowel 96. The dowel jacket 90 clips onto the frame wires 93*a* and 93*b*. Inline connectors attach the frame wires of two dowel basket sections of together. Frame wires, dowel jackets, dowels and inline connectors can be assembled in the field to string a desired number of dowel basket sections together into a dowel basket of desired length.

Figure 10A:
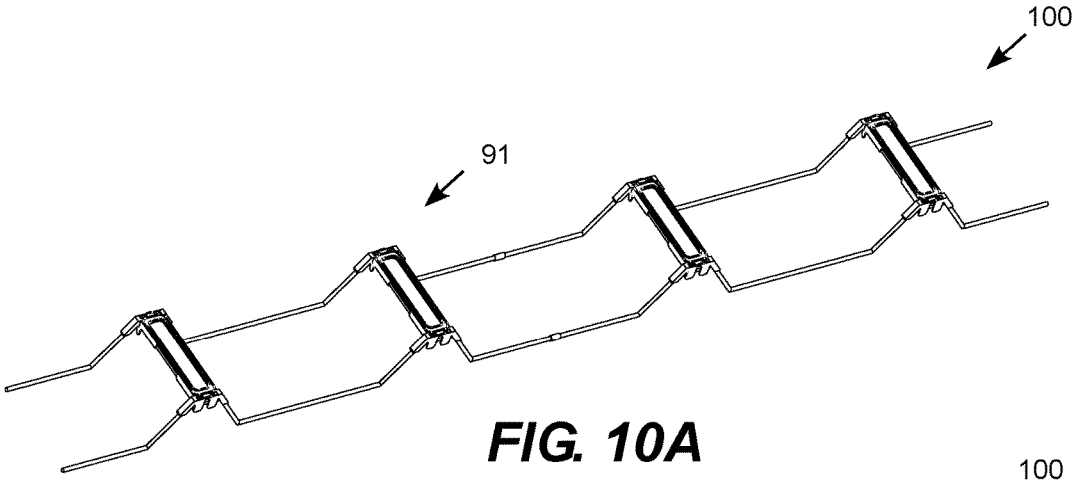
FIG. 10A is an assembled view of a dowel basket with rectangular plate dowels.
Figure 10B:
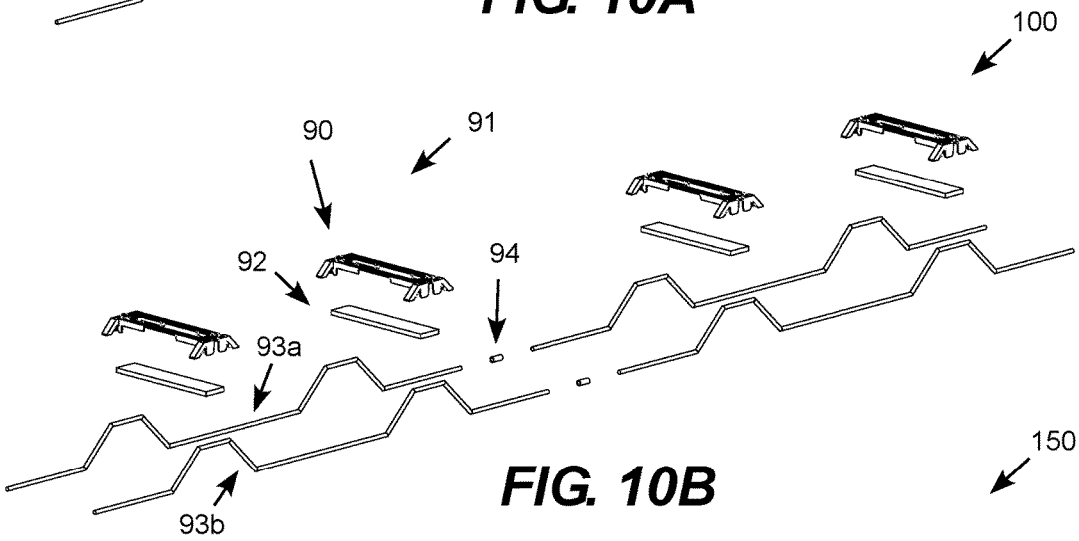
FIG. 10B is an exploded assembly view of the dowel basket with rectangular plate dowels.
Figure 10C:
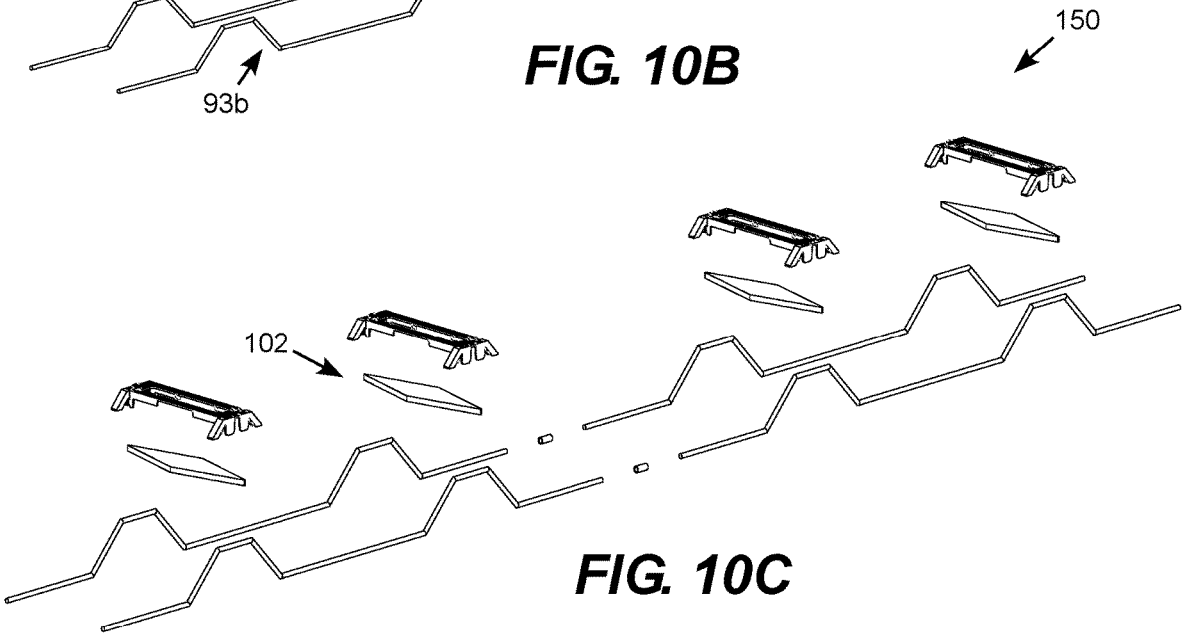
FIG. 10C is an exploded assembly view of an alternative dowel basket with elongated diamond-shaped plate dowels.
Figure 11A:
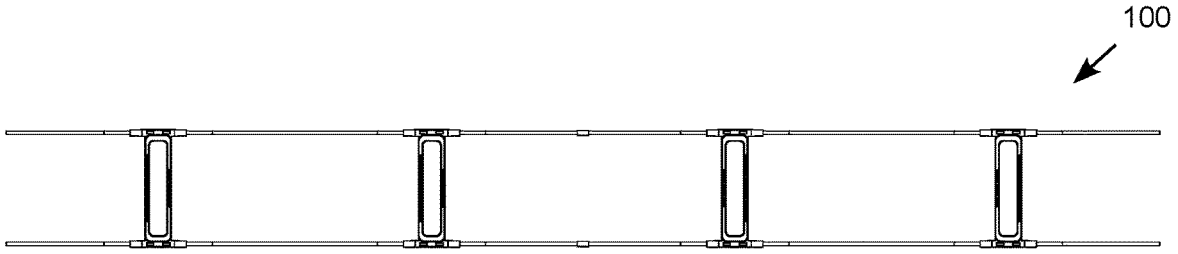
FIG. 11A is a top view of a dowel basket supporting a rectangular plate dowels.
Figure 11B:
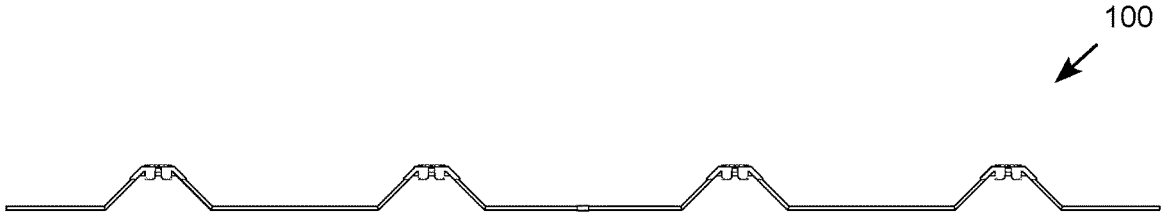
FIG. 11B is a side view of the dowel basket supporting the rectangular plate dowels.
Figure 11C:
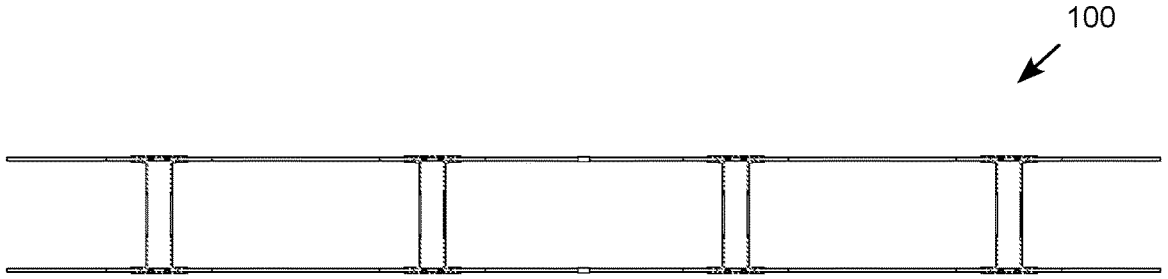
FIG. 11C is a bottom view of the dowel basket supporting the rectangular plate dowels.
Figure 11D:
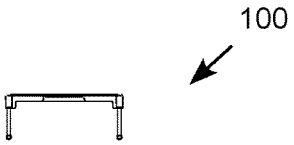
FIG. 11D is an end view of the dowel basket supporting the rectangular plate dowels.

FIG. 10A shows a dowel basket 100 with two dowel basket sections. Each dowel basket section includes two dowel jacket assemblies represented by the enumerated dowel jacket assembly 91. The enumerated dowel jacket assembly 91 includes a dowel jacket 90 and a rectangular plate dowel 92 connected to a pair of frame wires 93*a*-93*b*. Each dowel basket section is connected to an adjacent dowel basket section by a pair of inline connectors represented by the enumerated connector 94. FIG. 10B shows an exploded assembly view of a dowel basket 150, which is the same as the dowel basket 100 except that the rectangular plate dowel 92 shown in FIG. 10A is replaced by the elongated diamond-shaped plate dowel 102 shown in FIG. 10B. FIGS. 11A-11D show top, side, bottom and end views of the dowel basket 100.

Figure 12A:
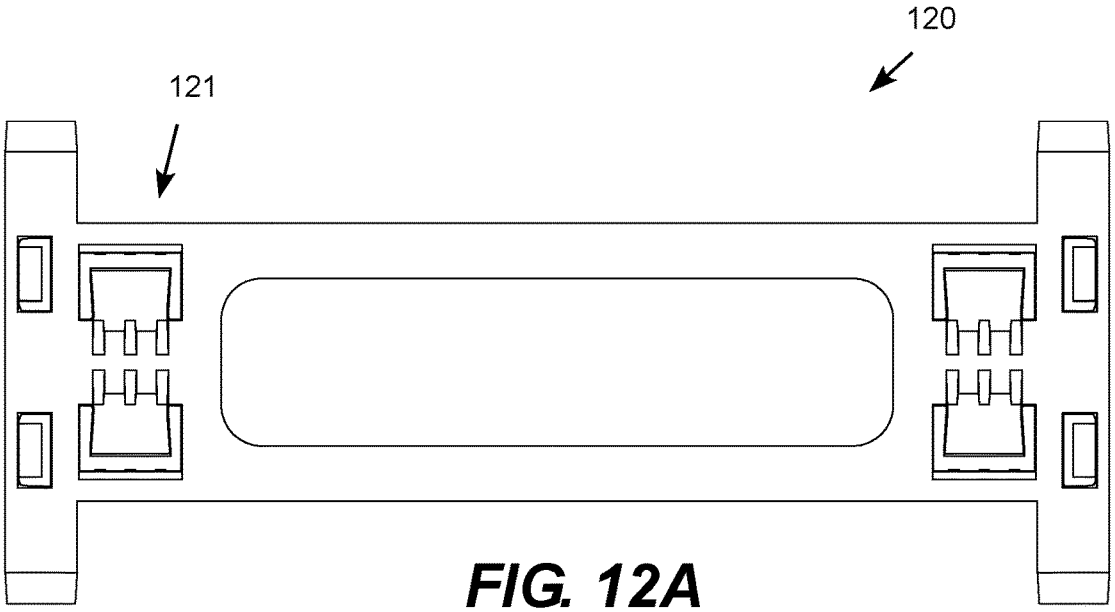
FIG. 12A is a top view of an alternative dowel jacket including clip receivers allowing it to support a dowel bar.
Figure 12B:
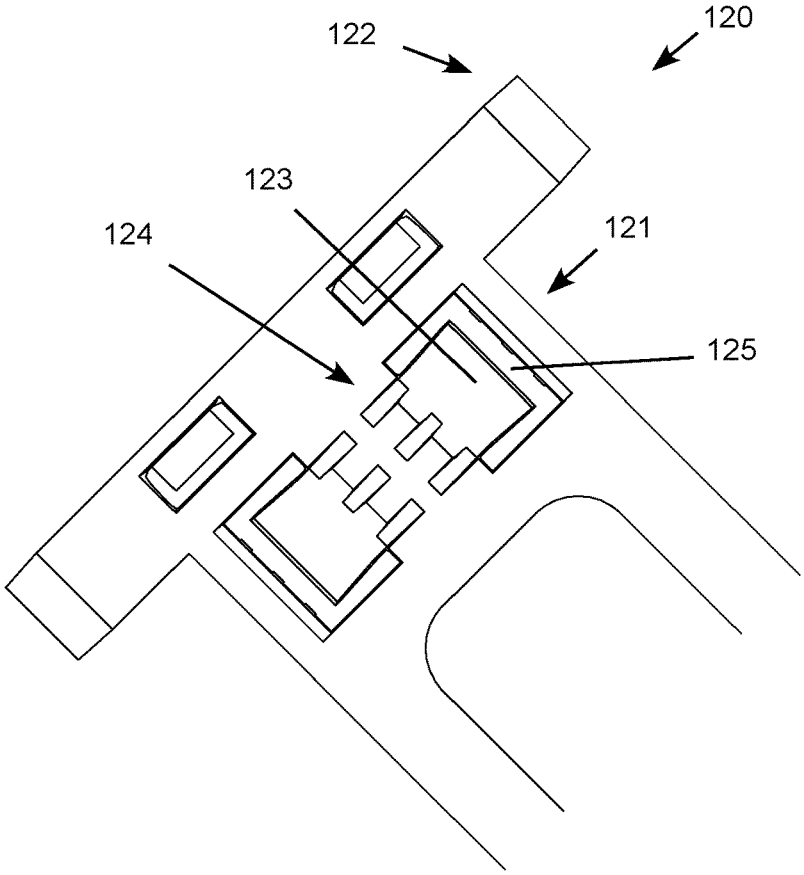
FIG. 12B is an enlarged top view of a portion of the dowel jacket of FIG. 12A.
Figure 13A:
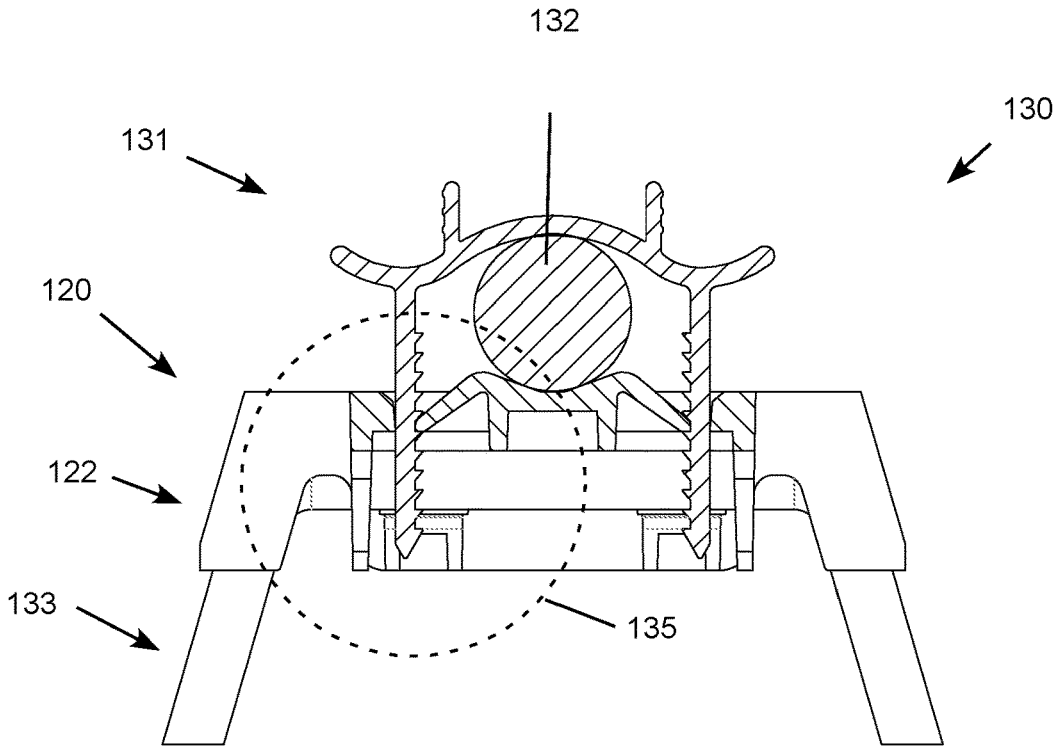
FIG. 13A is a cut-away view of a dowel basket section.
Figure 13B:
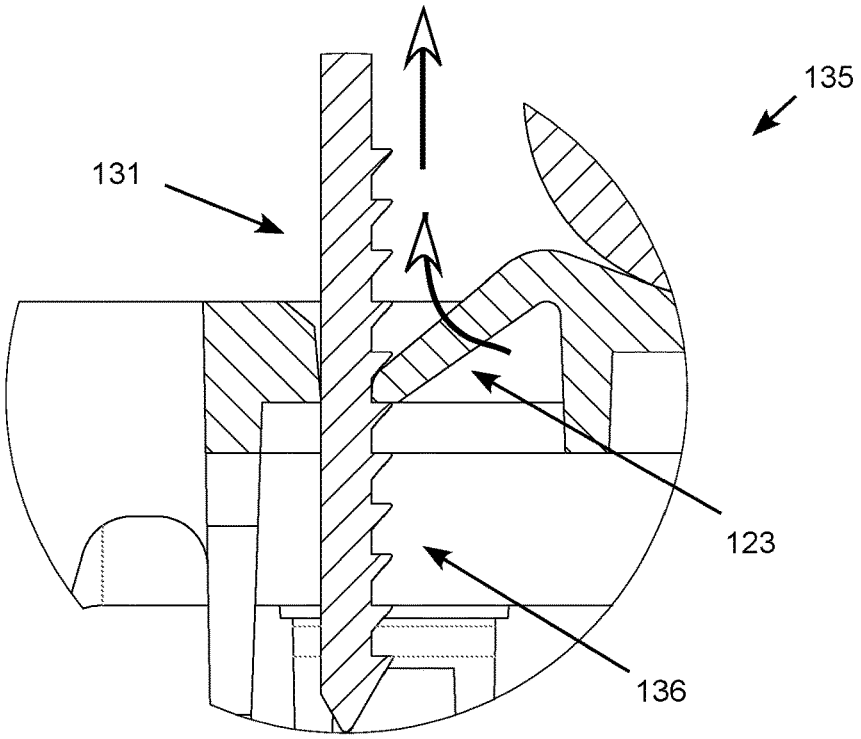
FIG. 13B is an enlarged view of a portion of the dowel basket section of FIG. 13A.
Figure 14A:
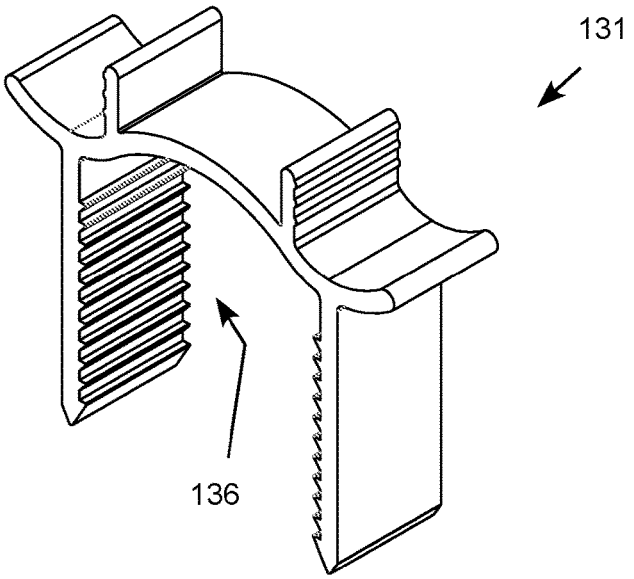
FIG. 14A is a perspective view of a dowel clip.
Figure 14B:
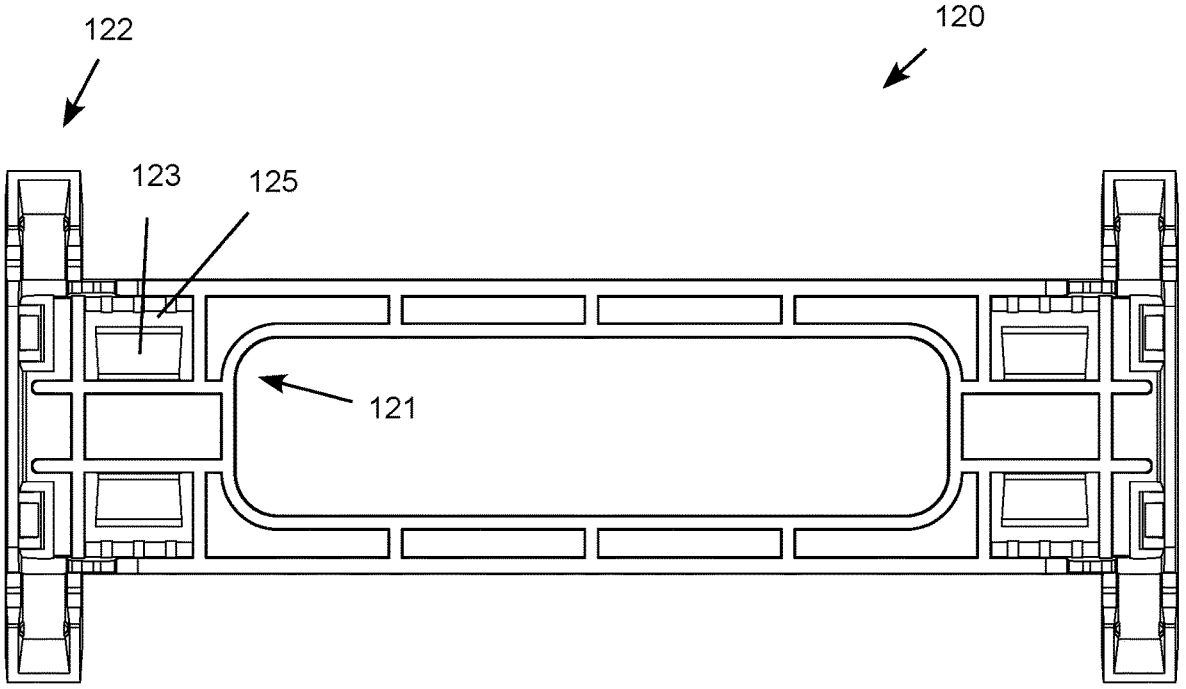
FIG. 14B is a bottom view of a dowel jacket.

FIGS. 12A and 12B show an alternative dowel jacket 120 that includes a pair of clip receivers represented by the enumerated clip receiver 121 allowing it to hold a dowel bar (also referred to as a dowel rod), such as a rod with a round cross-section. Dowel bars with other shapes, such as a rod with a square, rectangular or other suitable cross-section, may also be utilized. FIGS. 13A-13B show a dowel jacket assembly 130 that includes the dowel jacket 120 and a pair of dowel clips, represented by the enumerated dowel clip 131, that holds a dowel bar 132 to the dowel jacket. The dowel jacket 120 is clipped to a pair of frame wires represented by the enumerated frame wire 133. FIG. 13A calls out a detail 135, which is enlarged in FIG. 13B, which shows the dowel clip 131 including serrations 136 that engage with tongues represented by the enumerated tongue 123 to hold the dowel clip 131 in place in the dowel jacket 120. FIG. 14A shows the dowel clip 131 with serrations 136 and FIG. 14B shows the underside of the dowel jacket 120. Referring back to FIG. 12B, the representative clip receiver 121, which is located adjacent to a leg-clip structure 122, includes a tongue 123 strengthened by the support ribs 124 positioned at the edge of a clip slot 125. A dowel clip 131 as shown in FIGS. 13A-13B and FIG. 14A, which fits into the clip slot 125, includes serrations 136 that engage with the tongue 123 to secure the dowel clip in the clip slot 125. A pair of dowel clips secure the bar dowel 132 to the dowel jacket 120.

Figure 15A:
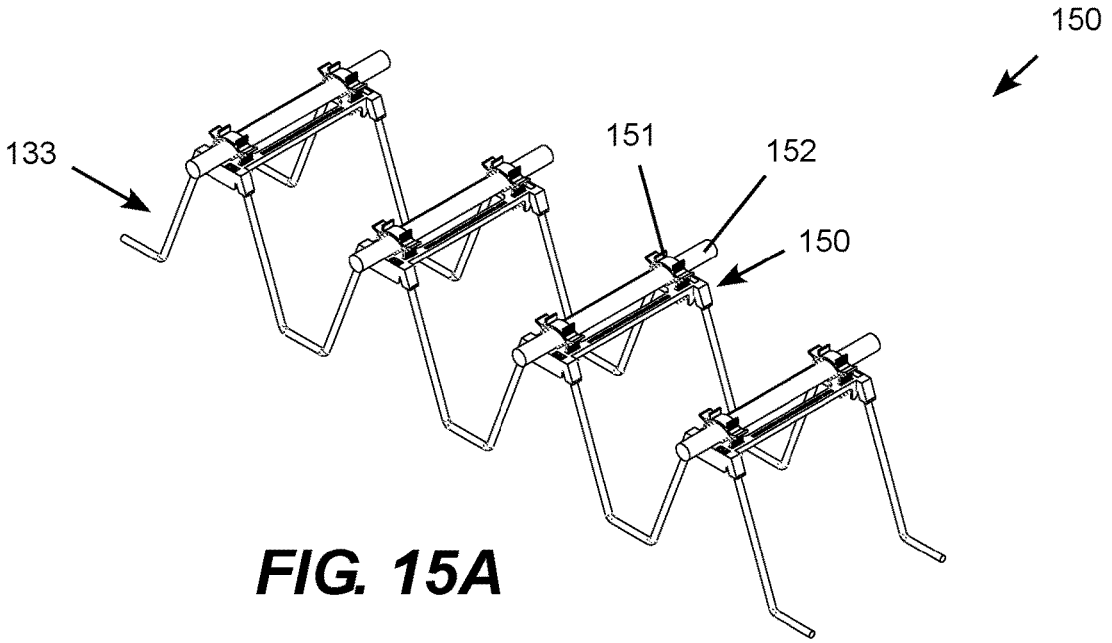
FIG. 15A is a perspective view of a dowel basket with dowel bars.
Figure 15B:
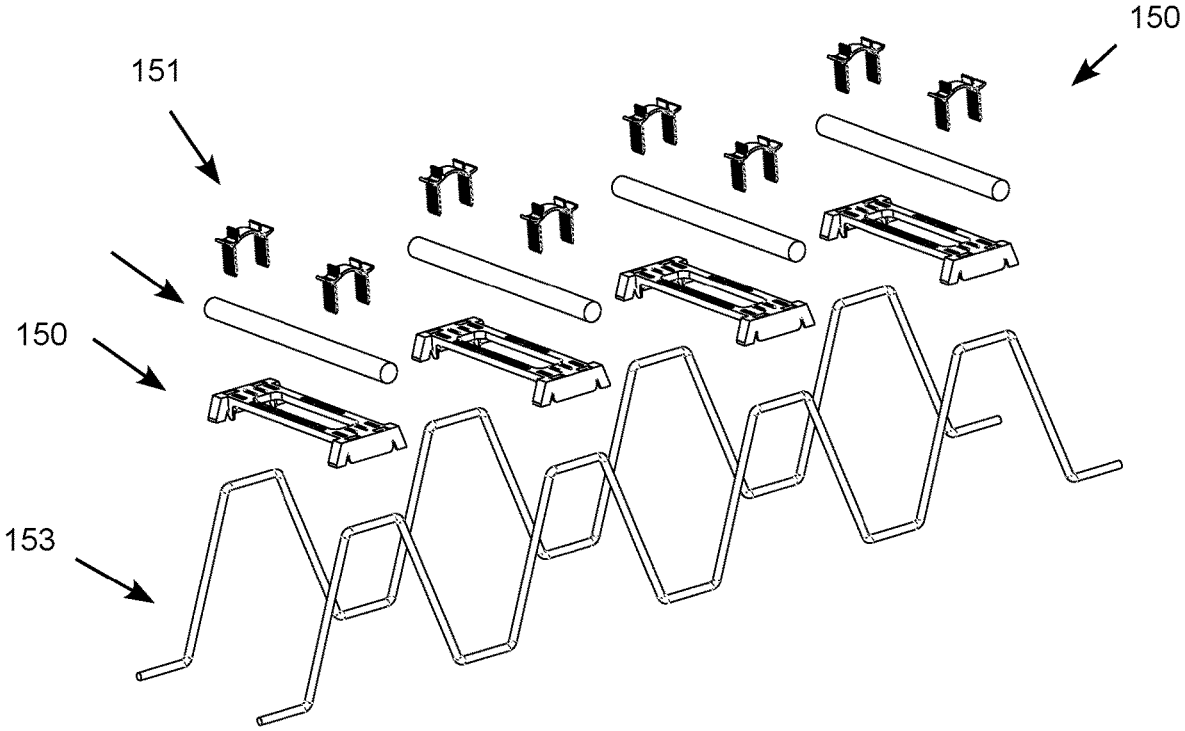
FIG. 15B an exploded assembly view of the dowel basket with dowel bars.
Figure 16A:
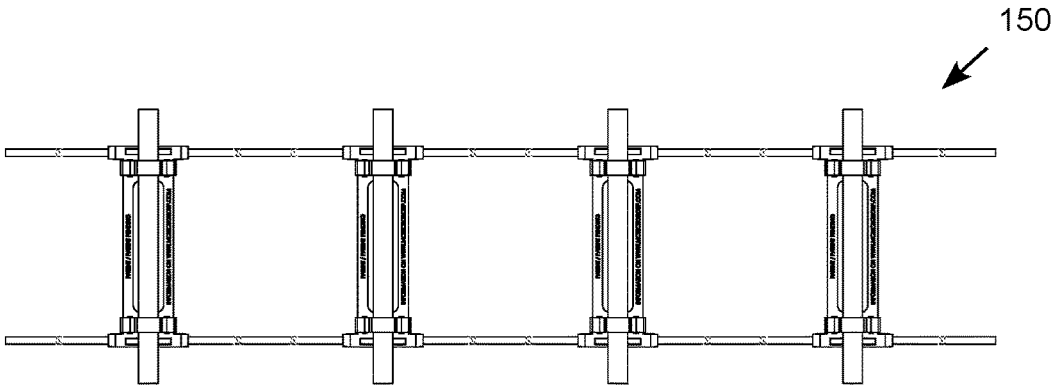
FIG. 16A is a top view of the dowel basket with dowel bars.
Figure 16B:
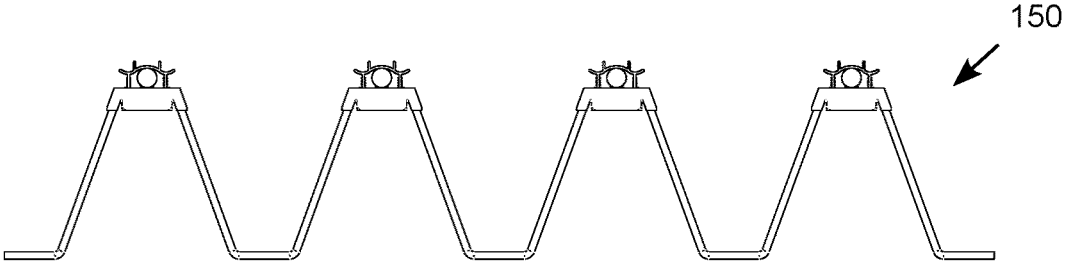
FIG. 16B is a side view of the dowel basket with dowel bars.
Figure 16C:
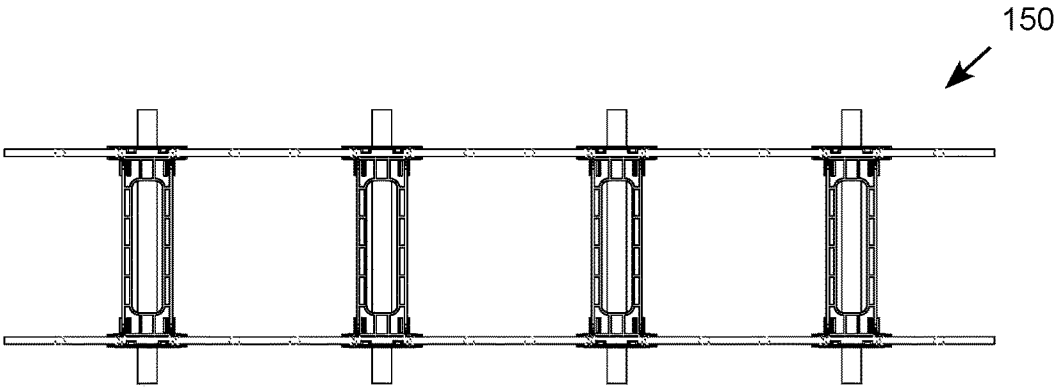
FIG. 16C is a bottom view of the dowel basket with dowel bars.
Figure 16D:
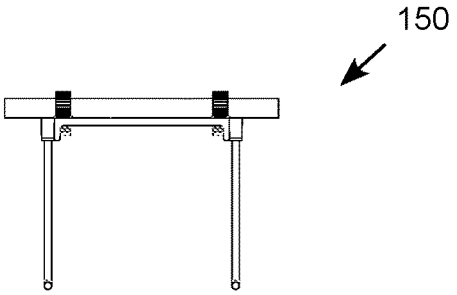
FIG. 16D is an end view of the dowel basket with dowel bars.

FIG. 15A shows an assembled view and FIG. 15B shows an exploded assembly view of a dowel basket 150 that includes dowel jackets represented by the enumerated dowel jacket 150, dowel clips represented by the enumerated dowel clip 151, dowel bars represented by the enumerated dowel bar 152, and frame wires represented by the enumerated frame wire 153. FIGS. 16A-16D show top, side, bottom and end views of the dowel basket 150. In this this embodiment, the dowel bar 152 is attached to the top side of the dowel jacket 120.

Figure 17A:
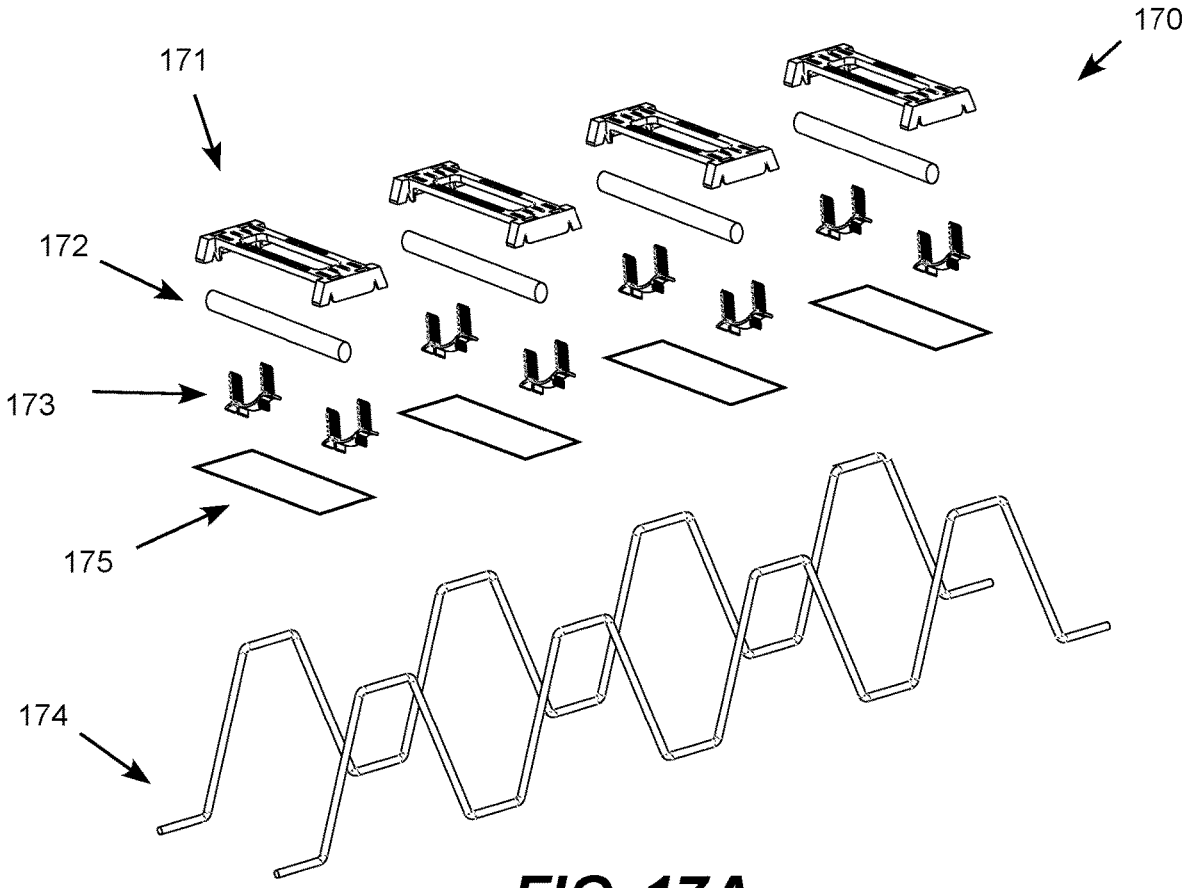
FIG. 17A is an exploded assembly view of a dowel basket with dowel bars attached by clips below the dowel jackets.

FIG. 17A shows an exploded assembly view of an alternative dowel basket 170 that includes dowel jackets represented by the enumerated dowel jacket 171, dowel bars represented by the enumerated dowel bar 172, dowel clips represented by the enumerated dowel clip 173, and frame wires represented by the enumerated frame wire 174. In this this embodiment, the dowel bar 172 is attached to the bottom side of the dowel jacket 171. Tape 175 may be attached below the dowel bar covering the bottom side of the dowel jacket 171 to prevent the concrete from hardening the dowel bar 172 to the dowel jacket 171. This accommodates relative movement of the concrete slabs without cracking the concrete.

Figure 17B:
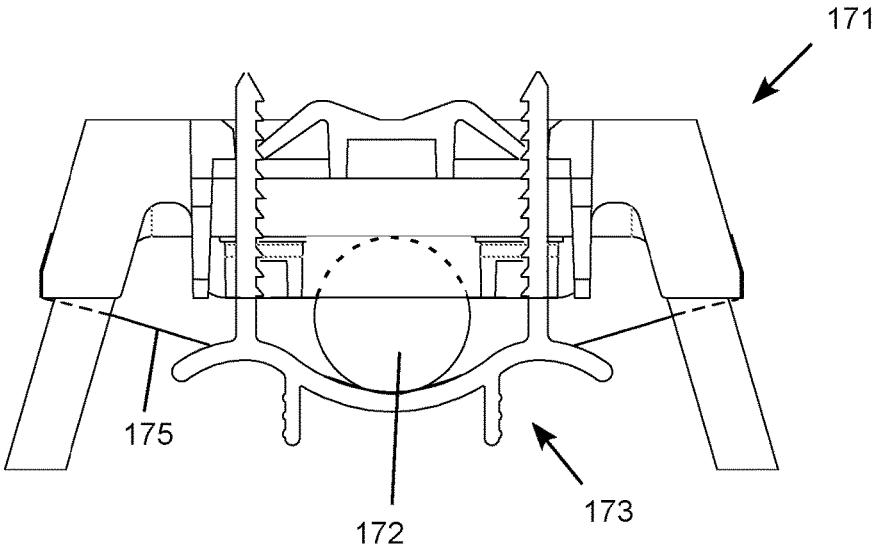
FIG. 17B a cut-away view of a dowel basket section of the dowel basket of FIG. 17A.

While the representative embodiments shown in the figures include dowel assemblies in each section, dowel basket sections with different numbers of dowel assemblies may be fabricated. For example, dowel basket sections that have one dowel assembly in each section may be fabricated, dowel basket sections that have three dowel assemblies in each section may be fabricated, and so forth. In addition, while tape enclosing the bottom side of the dowel jacket is only illustrated for the dowel bar embodiments in FIGS. 17A-17B, tape may be used to similarly enclose the bottom sides of the dowel jackets in any of the embodiments with dowels positioned below the dowel jackets to prevent the concrete from hardening the dowels to the dowel jackets.

Although the field-assembly dowel baskets have been illustrated in the context of horizontal pavement construction, it will be appreciated that the dowel basket is well adapted for, but not limited to, road and floor construction. It should be appreciated that the field-assembly dowel baskets can be used for any concrete joint of sufficient size regardless of its intended purpose or orientation. For example, the invention is equally applicable to joints in concrete roads, sidewalks, floors, walls, ceilings, abutments and other structures. Those skilled in the art will appreciate that the foregoing describes preferred embodiments of the invention and that many adjustments and alterations will be apparent to those skilled in the art within the spirit and scope of the invention as defined by the appended claims.

The invention claimed is:

1. A dowel basket comprising:

a plurality of dowels, a plurality of dowel jackets configured to support the dowels, a plurality of frame wires, and a plurality of inline connectors removably attachable to the wire frame wires;

wherein each dowel jacket is configured to support a respective dowel;

wherein a pair of frame wires is configured to support one or more dowel jackets;

wherein the dowels, dowel jackets, and frame wires are configured to be assembled into a plurality of dowel basket sections;

wherein the dowel basket sections are configured to be connected to each other by the inline connectors to assemble a dowel basket;

wherein each frame wire comprises at least two risers connecting two ground runners to a crossbar;

wherein each dowel jacket comprises a pair of leg-clip structures, each for firmly attaching the dowel jacket to a respective frame wire;

wherein each leg-clip structure comprises two leg clips, each leg clip configured to clip to a respective frame wire riser, and a central clip configured to clip to a frame wire crossbar.

2. The dowel basket of claim 1, wherein each dowel jacket is configured to interchangeably support a rectangular plate dowel or an elongated diamond-shaped plate dowel.

3. The dowel basket of claim 1, wherein each dowel jacket is configured to interchangeably support a plate dowel or dowel bar.

4. The dowel basket of claim 1, wherein each dowel jacket is configured to interchangeably support a rectangular plate dowel, an elongated diamond-shaped plate dowel, or a dowel bar.

5. The dowel basket of claim 1, wherein each dowel jacket is configured to receive two dowel clips attaching one of the dowel bars to the dowel jacket.

6. The dowel basket of claim 1, wherein:

each dowel jacket is configured to receive two dowel clips attaching one of the dowel bars to the dowel jacket; and each dowel jacket comprises two sets of tongues, wherein each tongue is configured to engage with serrations of a respective dowel clip to attach the dowel clip to the dowel jacket.

7. The dowel basket of claim 1, wherein each dowel is a dowel bar, further comprising a plurality dowel clips, wherein each dowel clip is configured to attach a respective dowel bar to a respective dowel jacket.

8. The dowel basket of claim 7, wherein each dowel jacket comprises a plurality of tongues, wherein each tongue is configured to engage with serrations of a respective dowel clips to attach the dowel clip to the dowel jacket.

9. A method for constructing a concrete structure at a construction site, comprising:

manufacturing or obtaining components of field-assembly dowel baskets;

transporting the components in bulk quantities to the construction site;

assembling a dowel basket of desired length from the components at the construction site, wherein the dowel basket comprises a plurality of dowel basket sections connected together with inline connectors, positioning the dowel basket at the edge of a first concrete slab to be poured;

positioning a concrete form around dowels of the dowel basket, wherein the form comprises notches configured to accommodate the dowels;

pouring the first concrete slab so that a first portion of each dowel is embedded in the first slab and a second portion of each dowel extends from the first slab;

after the first slab sets, removing the form and pouring a second concrete slab adjacent to the first concrete slab over the second portions of the dowels so that the dowels span a joint between the first and second concrete slabs; and and wherein each dowel basket section comprises:

a plurality of dowels, a plurality of dowel jackets configured to support the dowels, and a plurality of frame wires, each dowel jacket is configured to support a respective dowel, wherein a pair of frame wires is configured to support one or more dowel jackets, the dowels, dowel jackets, and frame wires are configured to be assembled into a plurality of dowel basket sections, the dowel basket sections are configured to be connected to each other by the inline connectors to assemble a dowel basket, each frame wire comprises at least two risers connecting two ground runners to a crossbar, each dowel jacket comprises a pair of leg-clip structures, each for firmly attaching the dowel jacket to a respective frame wire, and each leg-clip structure comprises two leg clips, each leg clip configured to clip to a respective frame wire riser, and a central clip configured to clip to a frame wire crossbar.

10. The method of claim 9, wherein each dowel jacket is configured to interchangeably support a rectangular plate dowel or an elongated diamond-shaped plate dowel.

11. The method of claim 9, wherein each dowel jacket is configured to interchangeably support a plate dowel or dowel bar.

12. The method of claim 9, wherein each dowel jacket is configured to interchangeably support a rectangular plate dowel, an elongated diamond-shaped plate dowel, or a dowel bar.

13. The method of claim 9, wherein each dowel is a dowel bar, further comprising a plurality dowel clips, wherein each dowel clip is configured to attach a respective dowel bar to a respective dowel jacket.

14. The method of claim 9, wherein each dowel jacket is configured to receive two dowel clips attaching one of the dowel bars to the dowel jacket.

15. The method of claim 9, wherein each dowel jacket comprises a plurality of tongues, wherein each tongue is configured to engage with serrations of a respective dowel clips to attach the dowel clip to the dowel jacket.

16. The method of claim 9, wherein:

each dowel jacket is configured to receive two dowel clips attaching one of the dowel bars to the dowel jacket; and each dowel jacket comprises two sets of tongues, wherein each tongue is configured to engage with serrations of a respective dowel clip to attach the dowel clip to the dowel jacket.

17. A dowel basket, comprising:

a plurality of dowels basket sections connected together with inline connectors;

wherein each dowel basket section comprises one or more dowels, one or more dowel jackets supporting respective dowels, and a plurality of frame wires;

wherein each dowel jacket is supports a respective dowel;

wherein a pair of frame wires supports one or more dowel jackets;

wherein each frame wire comprises at least two risers connecting two ground runners to a crossbar;

wherein each dowel jacket comprises a pair of leg-clip structures, each firmly attaching the dowel jacket to a respective frame wire;

wherein each leg-clip structure comprises two leg clips, each leg clip configured to clip to a respective frame wire riser, and a central clip configured to clip to a frame wire crossbar.

18. The dowel basket of claim 17, wherein each dowel jacket supports a rectangular plate dowel.

19. The dowel basket of claim 17, wherein each dowel jacket supports an elongated diamond-shaped plate dowel.

20. The dowel basket of claim 17, wherein each dowel jacket supports a dowel bar.

* * * * *